US012590344B2

(12) United States Patent
Hasegawa et al.

(10) Patent No.: US 12,590,344 B2
(45) Date of Patent: Mar. 31, 2026

(54) HIGH-STRENGTH HOT-ROLLED STEEL SHEET AND METHOD FOR MANUFACTURING THE SAME

(71) Applicant: JFE Steel Corporation, Tokyo (JP)

(72) Inventors: Hiroshi Hasegawa, Tokyo (JP); Hideyuki Kimura, Tokyo (JP); Noriaki Moriyasu, Tokyo (JP); Sota Goto, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 627 days.

(21) Appl. No.: 17/910,421

(22) PCT Filed: Mar. 17, 2021

(86) PCT No.: PCT/JP2021/010938
§ 371 (c)(1),
(2) Date: Sep. 9, 2022

(87) PCT Pub. No.: WO2021/193310
PCT Pub. Date: Sep. 30, 2021

(65) Prior Publication Data

US 2023/0140191 A1 May 4, 2023

(30) Foreign Application Priority Data

Mar. 25, 2020 (JP) ..... 2020-053545

(51) Int. Cl.
*C21D 8/02* (2006.01)
*B21C 47/02* (2006.01)
(Continued)

(52) U.S. Cl.
CPC ..... *C21D 8/0226* (2013.01); *B21C 47/02* (2013.01); *C21D 8/0263* (2013.01); *C21D 9/46* (2013.01);
(Continued)

(58) Field of Classification Search
None
See application file for complete search history.

(56) References Cited

U.S. PATENT DOCUMENTS

2014/0299237 A1 10/2014 Somani et al.
2016/0369367 A1 12/2016 Shiraki et al.
2020/0224294 A1 7/2020 Hirashima et al.

FOREIGN PATENT DOCUMENTS

CN 101541992 A 9/2009
CN 103917682 A 7/2014
(Continued)

OTHER PUBLICATIONS

Office Action (Request for the Submission of an Opinion) issued Sep. 18, 2024, by the Korean Intellectual Property Office in corresponding Korean Patent Application No. 10-2022-7031737 and an English translation with Concise Statement of Relevance of the Office Action. (13 pages).
Chinese Office Action with Search Report for Chinese Application No. 202180020761.1, dated Feb. 20, 2023, 9 pages.
(Continued)

*Primary Examiner* — Jenny R Wu
(74) *Attorney, Agent, or Firm* — Buchanan Ingersoll & Rooney PC

(57) ABSTRACT

After low-temperature finish rolling has been performed on a steel material having a certain chemical composition, cooling is performed at an average cooling rate of 10° C./s or higher to a temperature of 500° C., rapid cooling is further performed in a temperature range from a Ms temperature to a temperature of (Ms temperature-200° C.), coiling is thereafter performed in a low temperature range of 250° C. or lower, and the coiled steel sheet is uncoiled and further subjected to rolling with a certain amount or more of rolling load per unit width and the like. Consequently, it is possible to obtain a high-strength hot-rolled steel sheet having a microstructure including, in terms of area fraction, 95% or more of a martensite phase at a position located at ¼ of the
(Continued)

thickness of the steel sheet, in which an average aspect ratio of prior austenite grains is 3.0 or more.

6 Claims, 1 Drawing Sheet

(51) Int. Cl.

| | |
|---|---|
| ***C21D 8/0221*** | (2026.01) |
| ***C21D 8/0247*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C22C 38/002* (2013.01); *C22C 38/02* (2013.01); *C22C 38/04* (2013.01); *C22C 38/06* (2013.01); *C21D 2211/001* (2013.01); *C21D 2211/008* (2013.01)

(56) References Cited

FOREIGN PATENT DOCUMENTS

| | | | | |
|---|---|---|---|---|
| EP | 2 098 309 | A1 | | 9/2009 |
| EP | 2105614 | A1 | | 9/2009 |
| EP | 2759615 | A1 | | 7/2014 |
| JP | 2011052321 | A | | 3/2011 |
| JP | 2014189808 | A | | 10/2014 |
| JP | 2015155572 | A | | 8/2015 |
| JP | 2016211073 | A | | 12/2016 |
| JP | 2017179540 | A | * | 10/2017 |
| KR | 10-1100051 | B1 | | 12/2011 |
| KR | 10-2019-0095459 | A | | 8/2019 |
| WO | 2018/123356 | A1 | | 7/2018 |
| WO | 2019031583 | A1 | | 2/2019 |

OTHER PUBLICATIONS

Extended European Search Report issued Nov. 15, 2024, by the European Patent Office in corresponding European Patent Application No. 21774000.0-1103. (13 pages).

International Search Report and Written Opinion for International Application No. PCT/JP2021/010938, dated Jun. 8, 2021, 5 pages.

* cited by examiner

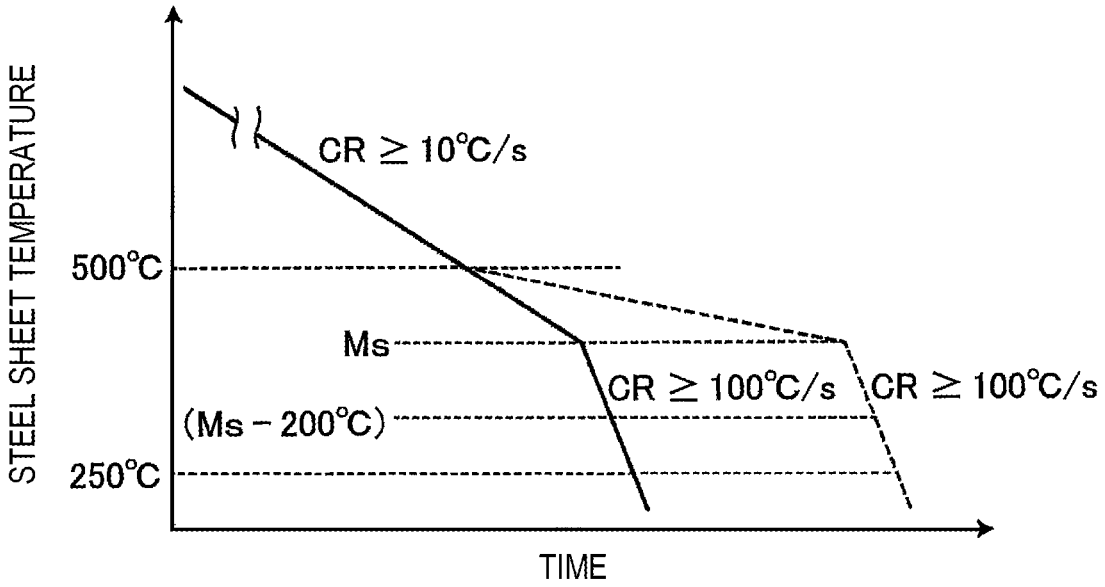
STEEL SHEET TEMPERATURE
CR ≥ 10°C/s
500°C
Ms
CR ≥ 100°C/s
CR ≥ 100°C/s
(Ms − 200°C)
250°C
TIME

HIGH-STRENGTH HOT-ROLLED STEEL SHEET AND METHOD FOR MANUFACTURING THE SAME

CROSS REFERENCE TO RELATED APPLICATIONS

This is the U.S. National Phase application of PCT/JP2021/010938, filed Mar. 17, 2021 which claims priority to Japanese Patent Application No. 2020-053545, filed Mar. 25, 2020, the disclosures of these applications being incorporated herein by reference in their entireties for all purposes.

FIELD OF THE INVENTION

The present invention relates to a high-strength hot-rolled steel sheet which can preferably be used as a material for automotive parts and a method for manufacturing the steel sheet. Here, the meaning of "steel sheet" includes a steel strip.

BACKGROUND OF THE INVENTION

Nowadays, from the viewpoint of improving the crashworthiness and fuel efficiency of automobiles, there is a demand for increasing the strength of a steel sheet used for automotive parts. On the other hand, in the case of a steel sheet having increased strength, since there is an increased risk of the occurrence of delayed fracture, improving delayed fracture resistance is important. In particular, since a hot-rolled steel sheet which is used for the chassis of automobiles and the like is exposed to a harsh corrosive environment, such a steel sheet is required to have excellent delayed fracture resistance.

In response to such requirements, for example, Patent Literature 1 proposes "HIGH-STRENGTH HOT-ROLLED STEEL SHEET AND METHOD FOR MANUFACTURING THE SAME". Patent Literature 1 describes the technique in which, as a result of a steel sheet having a chemical composition containing, by mass %, C: 0.08% or more and less than 0.16%, Si: 0.01% to 1.0%, Mn: 0.8% to 2.0%, Al: 0.005% to 0.10%, and N: 0.002% to 0.006% with Nb, Ti, Cr, and B and a microstructure including a martensite phase or a tempered martensite phase as a main phase, in which, in a cross section parallel to the rolling direction, the average grain size and aspect ratio of prior austenite grains are 20 μm or less and 18 or less, respectively, it is possible to easily manufacture a high-strength hot-rolled steel sheet having a yield strength of 960 MPa or higher which is excellent in terms of toughness and delayed fracture resistance and which is also excellent in terms of abrasion resistance.

In addition, Patent Literature 2 proposes "HIGH-STRENGTH STEEL SHEET AND METHOD FOR MANUFACTURING THE SAME". Patent Literature 2 describes the technique in which, a steel sheet having a chemical composition containing, by mass %, C: 0.12% to 0.40%, Si: 0.6% or less, Mn: 1.5% or less, Al: 0.15% or less, and N: 0.01% or less is subjected to an annealing treatment where the steel sheet is heated to and held in a temperature range equal to or higher than the $Ac_3$ transformation temperature and 950° C. or lower, is quenched from a temperature range of 600° C. or higher, and is tempered at a temperature of 350° C. or lower, and is then subjected to correction utilizing a leveler. Consequently, Patent Literature 2 states that it is possible to manufacture a high-strength steel sheet having a martensite single-phase microstructure including a region having a KAM value of 1° or more in an amount of 50% or more, having the maximum tensile residual stress controlled to be 80 MPa or lower in a surface region from the surface to a position located at ¼ of the thickness, and having excellent delayed fracture resistance in the cut end surface and base steel thereof.

In addition, Patent Literature 3 proposes "HIGH-STRENGTH STEEL SHEET WITH LOW YIELD RATIO EXCELLENT IN TERMS OF HYDROGEN-INDUCED CRACKING RESISTANCE AND BENDABILITY". Patent Literature 3 describes the technique in which it is possible to manufacture a high-strength steel sheet with a low yield ratio excellent in terms of both hydrogen-induced cracking resistance and bendability by controlling a chemical composition to contain, by mass %, C: more than 0.01% and 0.1% or less, Si: 0.05% to 0.45%, Mn: 0.5% to 1.6%, Al: 0.01% to 0.06%, N: 0.012% or less, and Ca: 0.0005% to 0.006% with at least one of V, Nb, and Ti in a total amount of 0.15% or less and controlling a microstructure in which when the steel sheet is divided into a surface layer, a center segregation portion, and a remaining ordinary portion, the ordinary portion includes 50% to 80% of ferrite and a balance including at least one of bainite, pearlite, and martensite-austenite constituent (MA), the center segregation portion includes 70% or more of bainite and a balance including at least one of ferrite, pearlite, and MA, in the center segregation portion the average grain size of bainite being 5 μm or less and the maximum length in the rolling direction and the maximum length in a direction perpendicular to the rolling direction and perpendicular to the thickness direction of pearlite grains and MA grains being both 10 μm or less, and a specified relationship is satisfied between the area fraction of ferrite in the surface layer and the area fraction of ferrite in the ordinary portion.

PATENT LITERATURE

PTL 1: Japanese Unexamined Patent Application Publication No. 2016-211073

PTL 2: Japanese Unexamined Patent Application Publication No. 2015-155572

PTL 3: Japanese Unexamined Patent Application Publication No. 2014-189808

SUMMARY OF THE INVENTION

However, in the technique according to Patent Literature 1, since it is not possible to sufficiently inhibit local concentration of hydrogen, delayed fracture resistance is low, which results in a problem in that it is not possible to achieve satisfactory delayed fracture resistance required in a harsh corrosive environment.

In addition, since the technique according to Patent Literature 2 is mainly intended for a cold-rolled steel sheet and requires complex processes such as an annealing treatment, correction utilizing a leveler, and the like, problems remain when the technique is used for a hot-rolled steel sheet. Moreover, in the technique according to Patent Literature 2, since it is not possible to sufficiently inhibit the local concentration of hydrogen, there is a problem in that it is not possible to achieve excellent delayed fracture resistance such that the requirements in a harsh corrosive environment are satisfied.

In addition, the technique according to Patent Literature 3 is intended for a steel sheet having a microstructure including 50% to 80% of ferrite and a strength level represented by a tensile strength TS of 590 MPa class, and only the effect for such steel sheet is clarified. In Patent Literature 3, there is no suggestion of a steel sheet having a strength level represented by a tensile strength of more than 590 MPa class, and, in particular, there is no suggestion of an improvement in the delayed fracture resistance of a high-strength steel sheet having a tensile strength of 1180 MPa or higher.

Aspects of the present invention are intended to solve the problems of the techniques of the related art described above, and an object according to aspects of the present invention is to provide a high-strength hot-rolled steel sheet excellent in terms of delayed fracture resistance which can preferably be used as a material for automotive parts and a method for manufacturing the steel sheet. Here, the expression "high strength" denotes a case of a tensile strength of 1180 MPa or higher and preferably 1700 MPa or lower. In addition, here, the expression "excellent in terms of delayed fracture resistance" denotes a case where, when an SSRT test (at a strain rate of 0.0000056 $s^{-1}$) is performed with hydrogen charged under the hydrogen charge condition in which the amount of diffusible hydrogen is 1.0 mass ppm at the time of breaking, the fracture stress is 90% or more of the tensile strength TS.

To achieve the object described above, the present inventors diligently conducted investigations regarding various factors having effects on delayed fracture resistance and, as a result, conceived improving delayed fracture resistance by forming a microstructure including mainly a martensite phase whose grains have a large aspect ratio and by forming a dislocation structure in which the number of movable dislocations is as small as possible. Since it is difficult to directly determine the number of movable dislocations, the present inventors devised a method in which the index of the number of movable dislocations in a steel sheet is defined as the amount of stress relaxation that is determined by performing a stress relaxation test in which, after a test specimen (steel sheet) has been subjected to constant tensile stress (a low stress of 400 MPa or lower), strain increase is stopped, and the amount of stress relaxation is thereafter determined after a lapse of a predetermined time. Specifically, the present inventors found that in order to improve delayed fracture resistance, it is effective that after the test specimen has been subjected to a tensile stress of 400 MPa, strain increase is stopped and the amount of stress relaxation is determined after a lapse of 5 min, and such an amount of stress relaxation is decreased to a predetermined value (20 MPa) or lower. It is considered that, since movable dislocations, which move when being subjected to a low stress of 400 MPa or lower, do not contribute to increasing strength, and since such movable dislocations tend to draw hydrogen, thereby contributing to hydrogen transport, such movable dislocations cause a decrease in delayed fracture resistance.

In addition, the present inventors found that it is possible to form a microstructure including mainly a martensite phase having a high dislocation density by performing finish rolling in a hot rolling process with a low finishing temperature, by cooling the hot-rolled steel sheet at a cooling rate of 10° C./s or higher to a temperature of 500° C., by further rapidly cooling the cooled steel sheet in a temperature range from the Ms temperature to a temperature of (Ms temperature-200° C.), and by coiling the cooled steel sheet in a low temperature range of 250° C. or lower and that it is possible to control the above-described amount of stress relaxation to be equal to or lower than a certain value by performing rolling on the formed microstructure with a rolling load equal to or higher than a certain value to form a dislocation structure in which dislocations tangle with each other, resulting in the completion of aspects of the present invention. The subject matter of aspects of the present invention is as follows.

[1] A high-strength hot-rolled steel sheet having a chemical composition containing, by mass %, C: 0.07% to 0.20%, Si: 1.50% or less, Mn: 1.0% to 4.0%, P: 0.030% or less, S: 0.0030% or less, Al: 0.010% to 1.000%, and a balance of Fe and incidental impurities, a microstructure including, in terms of area fraction, 95% or more of a martensite phase at a position located at ¼ of a thickness of the steel sheet, in which an average aspect ratio of prior austenite grains is 3.0 or more, an amount of stress relaxation after a lapse of 5 min of 20 MPa or lower in a stress relaxation test with an applied stress of 400 MPa, and a tensile strength of 1180 MPa or higher.

[2] The high-strength hot-rolled steel sheet according to item [1], in which the chemical composition further contains one, two, or more selected from Group A to Group E below.

Group A: by mass %, one, two, or more selected from Mo: 0.005% to 2.0%, V: 0.005% to 2.0%, Nb: 0.005% to 0.20%, and Ti: 0.005% to 0.20%

Group B: by mass %, one, two, or more selected from Cr: 0.005% to 2.0%, Ni: 0.005% to 2.0%, and Cu: 0.005% to 2.0%

Group C: by mass %, B: 0.0001% to 0.0050%

Group D: by mass %, one or two selected from Ca: 0.0001% to 0.0050% and REM: 0.0001% to 0.0050%

Group E: by mass %, one or two selected from Sb: 0.0010% to 0.10% and Sn: 0.0010% to 0.50%.

[3] The high-strength hot-rolled steel sheet according to item [1] or [2], in which the microstructure further includes, in terms of area fraction, 5% or less of a retained austenite phase.

[4] A method for manufacturing a high-strength hot-rolled steel sheet, the method including performing heating, rough rolling, and finish rolling on a steel material, in which the steel material is a steel material having the chemical composition according to item [1] or [2], in which the finish rolling is performed with a finishing delivery temperature of 890° C. or lower, and in which, after the finish rolling performed, cooling is performed at an average cooling rate of 10° C./s or higher to a temperature of 500° C. and at an average cooling rate of 100° C./s or higher in a temperature range from a Ms temperature to a temperature of (Ms temperature-200° C.), coiling is thereafter performed at a coiling temperature of 250° C. or lower, and the coiled steel sheet is subjected to at least one rolling pass with a rolling load per unit width of 0.20 ton/mm or more, or alternatively, after the finish rolling performed, the cooling is performed to a temperature of 250° C. or lower, and the cooled steel sheet, before being subjected to coiling, is subjected to at least one rolling pass with a rolling load per unit width of 0.20 ton/mm or more and then coiled.

According to aspects of the present invention, since there is a marked improvement in delayed fracture resistance while high strength represented by a tensile strength TS of 1180 MPa or higher is achieved, it is possible to manufacture a high-strength hot-rolled steel sheet excellent in terms of delayed fracture resistance which can preferably be used as a material for automotive parts, which has a significant effect on the industry. In addition, according to aspects of the present invention, there is also an effect of easily manufacturing products such as high-strength automotive parts and the like in which delayed fracture is less likely to occur.

BRIEF DESCRIPTION OF THE DRAWINGS

The FIGURE is a schematic diagram illustrating a preferable cooling pattern after finish rolling has been performed.

DETAILED DESCRIPTION OF EMBODIMENTS OF THE INVENTION

The high-strength hot-rolled steel sheet according to aspects of the present invention is a hot-rolled steel sheet having a tensile strength TS of 1180 MPa or higher and includes a non-pickled, so-called black surface, hot-rolled steel sheet and a pickled after hot rolling, so-called white surface, hot-rolled steel sheet. In addition, it is preferable that the high-strength hot-rolled steel sheet according to aspects of the present invention have a thickness of 0.6 mm or more and 10.0 mm or less, and, in the case where the steel sheet is used as a material for automotive parts, it is more preferable that the thickness be 1.0 mm or more and 6.0 mm or less, even more preferably 3.0 mm or less, or even much more preferably 2.0 mm or less. In addition, it is preferable that the steel sheet have a width of 500 mm or more and 1800 mm or less or more preferably 700 mm or more and 1400 mm or less.

Hereafter, the reasons for the limitations on the chemical composition of the high-strength hot-rolled steel sheet according to aspects of the present invention will be described. Hereafter, "%" related to a chemical composition denotes "mass %".

The high-strength hot-rolled steel sheet according to aspects of the present invention has a base chemical composition containing C: 0.07% to 0.20%, Si: 1.50% or less, Mn: 1.0% to 4.0%, P: 0.030% or less, S: 0.0030% or less, Al: 0.010% to 1.000%, and a balance of Fe and incidental impurities.

C: 0.07% to 0.20%

C is an element effective for contributing to the formation of martensite and increasing strength (tensile strength TS) by strengthening martensite. In the case where the C content is less than 0.078, since it is not possible to expect such effects to be sufficiently realized, it is not possible to achieve high strength represented by a tensile strength of 1180 MPa or higher. On the other hand, in the case where the C content is more than 0.20%, since there is a marked increase in the hardness of martensite, it is not possible to achieve the desired delayed fracture resistance. Therefore, the C content is set to be 0.07% to 0.20%. Here, it is preferable that the C content be 0.08% or more from the viewpoint of stably achieving a high strength represented by a tensile strength of 1180 MPa or higher, and it is preferable that the C content be 0.19% or less from the viewpoint of stabilizing delayed fracture resistance. Here, it is more preferable that the C content be 0.17% or less, or even more preferably 0.16% or less.

Si: 1.50% or Less

Si is an element effective for increasing strength (tensile strength TS) through solid solution strengthening or inhibiting temper softening of martensite. Such an effect becomes marked in the case where the Si content is 0.10% or more. From the viewpoint of more stably achieving high strength represented by a tensile strength of 1180 MPa or higher, it is preferable that the Si content be 0.10% or more. Here, it is more preferable that the Si content be 0.30% or more. On the other hand, in the case where the Si content is more than 1.50%, since an excessive amount of polygonal ferrite is formed, it is not possible to form the desired microstructure. Therefore, the Si content is set to be 1.50% or less. Here, it is preferable that the Si content be 1.30% or less or more preferably 0.90% or less.

Mn: 1.0% to 4.0%

Mn is an element effective for increasing tensile strength TS by forming martensite and lower bainite. In addition, Mn effectively contributes to achieving austenite grains having a large aspect ratio by inhibiting recrystallization of austenite. To realize such effects, it is necessary that the Mn content be 1.0% or more. In the case where the Mn content is less than 1.0%, since polygonal ferrite and the like are formed, and since austenite grains having a small aspect ratio are formed, there is a decrease in tensile strength TS and a decrease in delayed fracture resistance. From the viewpoint of more stably achieving high strength represented by a tensile strength of 1180 MPa or higher, it is preferable that the Mn content be 1.2% or more. On the other hand, in the case where the Mn content is more than 4.0%, since an excessive amount of retained austenite is formed, it is not possible to form the desired steel sheet microstructure. Therefore, the Mn content is set to be 1.0% to 4.0%. Here, from the viewpoint of improving delayed fracture resistance, it is preferable that the Mn content be 3.6% or less, more preferably 3.1% or less, or even more preferably 2.7% or less.

P: 0.030% or Less

P is an element which is contained as an incidental impurity and which causes a decrease in delayed fracture resistance. Therefore, in accordance with aspects of the present invention, it is preferable that the P content be as small as possible. However, it is acceptable that the P content be 0.030% or less. Therefore, the P content is set to be 0.030% or less. Here, it is preferable that the P content be 0.010% or less or more preferably 0.008% or less. However, in the case where an attempt is made to decrease the P content excessively, since there is a decrease in production efficiency, there is an increase in refining costs. Therefore, it is preferable that the P content be 0.001% or more.

S: 0.0030% or Less

S is an element which is contained as an incidental impurity and which causes a decrease in delayed fracture resistance. Therefore, in accordance with aspects of the present invention, it is preferable that the S content be as small as possible. However, it is acceptable that the S content be 0.0030% or less. Therefore, the S content is set to be 0.0030% or less. Here, it is preferable that the S content be 0.0020% or less or more preferably 0.0010% or less. However, in the case where an attempt is made to decrease the S content excessively, since there is a decrease in production efficiency, there is an increase in refining costs. Therefore, it is preferable that the S content be 0.0002% or more.

Al: 0.010% to 1.000%

Al is an element which functions as a deoxidizing agent, and it is necessary that the Al content be 0.010% or more from the viewpoint of using Al as a deoxidizing agent. On the other hand, in the case where the Al content is much more than 1.000%, since an excessive amount of polygonal ferrite is formed, it is not possible to form the desired steel sheet microstructure. Therefore, in accordance with aspects of the present invention, the Al content is set to be 0.010% to 1.000%. Here, it is preferable that the Al content be 0.50% or less or more preferably 0.300% or less.

The constituents described above are the base constituents, and, in accordance with aspects of the present invention, one, two, or more selected from Group A to Group E below may be added as needed as optional elements in addition to the base chemical composition described above:

Group A: one, two, or more selected from Mo: 0.005% to 2.0%, V: 0.005% to 2.0%, Nb: 0.005% to 0.20%, and Ti: 0.005% to 0.20%, Group B: one, two, or more selected from Cr: 0.005% to 2.0%, Ni: 0.005% to 2.0%, and Cu: 0.005% to 2.0%, Group C: B: 0.0001% to 0.0050%, Group D: one or two selected from Ca: 0.0001% to 0.0050% and REM: 0.0001% to 0.0050%, and Group E: one or two selected from Sb: 0.0010% to 0.10% and Sn: 0.0010% to 0.50%

Group A: One, Two, or More Selected from Mo: 0.005% to 2.0%, V: 0.005% to 2.0%, Nb: 0.005% to 0.20%, and Ti: 0.005% to 0.20%

Since Mo, V, Nb, and Ti constituting Group A are elements which are all effective for improving delayed fracture resistance by forming carbides, one, two, or more selected from these elements may be added as needed. To realize such an effect, it is preferable that the Mo content be 0.005% or more, the V content be 0.005% or more, the Nb content be 0.005% or more, or the Ti content be 0.005% or more. On the other hand, in the case where the Mo content is more than 2.0%, the V content is more than 2.0%, the Nb content is more than 0.20%, or the Ti content is more than 0.20%, since there is an increase in the grain size of the carbides, there is a decrease in hardenability, which may result in the desired steel sheet microstructure not being formed. Therefore, in the case where these elements are added, it is preferable that the Mo content be 0.005% to 2.0%, the V content be 0.005% to 2.0%, the Nb content be 0.005% to 0.20%, and the Ti content be 0.005% to 0.20%. Here, it is more preferable that the Mo content be 0.05% or more and 0.6% or less, the V content be 0.05% or more and 0.3% or less, the Nb content be 0.01% or more and 0.1% or less, and the Ti content be 0.01% or more and 0.2% or less.

Group B: One, Two, or More Selected from Cr: 0.005% to 2.0%, Ni: 0.005% to 2.0%, and Cu: 0.005% to 2.0%

Since Cr, Ni, and Cu constituting Group B are elements all effective for increasing strength by forming martensite, one, two, or more selected from these elements may be added as needed. To realize such an effect, it is preferable that the Cr content be 0.005% or more, the Ni content be 0.005% or more, or the Cu content be 0.005% or more. On the other hand, in the case where the Cr content is more than 2.08, the Ni content is more than 2.08, or the Cu content is more than 2.0%, since an excessive amount of retained austenite is formed, it is not possible to form the desired steel sheet microstructure. Therefore, in the case where these elements are added, it is preferable that the Cr content be 0.005% to 2.0%, the Ni content be 0.005% to 2.0%, and the Cu content be 0.005% to 2.0%. Here, it is more preferable that the Cr content be 0.1% or more and 0.6% or less, the Ni content be 0.1% or more and 0.6% or less, and the Cu content be 0.1% or more and 0.6% or less.

Group C: B: 0.0001% to 0.0050%

Since B constituting Group C is an element effective for increasing strength by increasing the hardenability of a steel sheet and thereby forming martensite, B may be added as needed. To realize such an effect, it is preferable that the B content be 0.0001% or more. On the other hand, in the case where the B content is more than 0.0050%, since there is an increase in the amount of B compounds (boron compounds), there is a decrease in hardenability, which may result in the desired steel sheet microstructure not being formed. Therefore, in the case where B is added, it is preferable that the B content be 0.0001% to 0.0050%. Here, it is more preferable that the B content be 0.0005% or more and 0.0040% or less or even more preferably 0.0010% or more and 0.0035% or less.

Group D: One or Two Selected from Ca: 0.0001% to 0.0050% and REM: 0.0001% to 0.0050%

Since Ca and REM constituting Group D are both elements effective for contributing to improving workability through the morphological control of inclusions, one or two selected from these elements may be added as needed. To realize such an effect, it is preferable that the Ca content be 0.0001% or more or the REM content be 0.0001% or more. On the other hand, in the case where the Ca content is more than 0.0050% or the REM content is more than 0.0050%, since there is an increase in the amounts of inclusions, there may be a deterioration in workability. Therefore, in the case where these elements are added, it is preferable that the Ca content be 0.0001% to 0.0050% and the REM content be 0.0001% to 0.0050%. Here, it is more preferable that the Ca content be 0.0005% or more and 0.0030% or less and the REM content be 0.0005% or more and 0.0030% or less.

Group E: One or Two Selected from Sb: 0.0010% to 0.10% and Sn: 0.0010% to 0.50%

Since Sb and Sn constituting Group E are both elements effective for contributing to inhibiting a decrease in the strength of steel, one or two selected from these elements may be added as needed. Sb contributes to inhibiting a decrease in the strength of steel by inhibiting denitrification, deboronization, and the like, and Sn contributes to inhibiting a decrease in the strength of steel by inhibiting the formation of pearlite. To realize such effects, it is preferable that the Sb content be 0.0010% or more or the Sn content be 0.0010% or more. On the other hand, in the case where the Sb content is more than 0.10% or the Sn content is more than 0.50%, embrittlement may occur in a steel sheet. Therefore, in the case where these elements are added, it is preferable that the Sb content be 0.0010% to 0.10% and the Sn content be 0.0010% to 0.50%. Here, it is more preferable that the Sb content be 0.0050% or more and 0.050% or less and the Sn content be 0.0050% to 0.050%.

The remainder other than the constituents described above is Fe and incidental impurities.

Although N is contained as an incidental impurity, it is preferable that the N content be as small as possible from the viewpoint of inhibiting the formation of nitrides. However, in accordance with aspects of the present invention, it is acceptable that the N content be 0.010% or less. In addition, as incidental impurities, Zr and Mg may be contained in a total amount of 0.002% or less. In the case where the total amount of Zr and Mg is more than 0.002%, since there is an increase in the amount of inclusions, there is a tendency for workability to be decreased. In addition, Cr, Ni, Cu, Mo, V, Nb, Ti, B, Ca, REM, Sb, and Sn, which are optional elements, may be contained as incidental impurities as long as the contents of these elements are less than the respective lower limits described above, because this causes no decrease in the effects according to aspects of the present invention.

Hereafter, the microstructure of the high-strength hot-rolled steel sheet according to aspects of the present invention will be described.

The high-strength hot-rolled steel sheet according to aspects of the present invention has a microstructure including, in terms of area fraction, 95% or more of a martensite phase at a position located at ¼ of the thickness of the steel sheet, in which an average aspect ratio of prior austenite grains is 3.0 or more. Here, the expression a "position located at ¼ of the thickness of the steel sheet" denotes not only an exact position located at ¼ of the thickness of the steel sheet but also a region, when the thickness of the steel sheet is defined as t, from a position located (t/4−100 μm) from the steel sheet surface to a position located (t/4+100 μm) from the steel sheet surface.

Martensite Phase: 95% or More in Terms of Area Fraction

In accordance with aspects of the present invention, to achieve both high strength (high tensile strength TS) and excellent delayed fracture resistance, it is necessary that the microstructure at a position located at ¼ of the thickness of the steel sheet include a martensite phase in an amount of 95% or more in terms of area fraction. In the case where the area fraction of a martensite phase is less than 95%, it is not possible to achieve the desired high strength, or it is not possible to achieve the desired delayed fracture resistance. Therefore, the microstructure at a position located at ¼ of the thickness of the steel sheet should include a martensite phase in an amount of 95% or more in terms of area fraction. Here, it is preferable that the area fraction be 97% to 100% or more preferably 98% to 100%. Regarding phases other than a martensite phase, it is acceptable that a bainite phase and the like be included in a total amount of less than 5% in terms of area fraction.

Average Aspect Ratio of Prior Austenite Grains: 3.0 or More

A martensite phase formed from austenite grains having a large aspect ratio is a phase which has a high dislocation density and which is thereby effective for increasing both tensile strength TS and delayed fracture resistance. To realize such effects, it is necessary that the average aspect ratio of prior austenite grains be 3.0 or more. In the case where the average aspect ratio of prior austenite grains is less than 3.0, it is not possible to achieve the desired delayed fracture resistance. Therefore, the average aspect ratio of prior austenite grains is set to be 3.0 or more. Here, it is preferable that the average aspect ratio be 4.0 or more or more preferably 5.0 or more. In addition, although there is no particular limitation on the upper limit of the average aspect ratio, the aspect ratio is about 20.0 or less as long as the steel sheet is manufactured by using the method within the range according to aspects of the present invention.

The above-described microstructure of the high-strength hot-rolled steel sheet according to aspects of the present invention may further include a retained austenite phase in an amount of 5% or less in terms of area fraction.

Retained Austenite Phase: 5% or Less in Terms of Area Fraction

Since a retained austenite phase causes a decrease in delayed fracture resistance, in accordance with aspects of the present invention, it is preferable that a retained austenite phase not be included (that is, have an area fraction of 0%) or that the area fraction be as small as possible, even in the case where a retained austenite phase is included. In addition, it is acceptable that the area fraction of a retained austenite phase be 5% or less. Therefore, in the case where a retained austenite phase is included, it is preferable that the area fraction of a retained austenite phase be 5% or less. Here, it is more preferable that the area fraction be 3% or less or more preferably 2% or less.

Moreover, the high-strength hot-rolled steel sheet according to aspects of the present invention has a microstructure in which the amount of stress relaxation after a lapse of 5 min is 20 MPa or lower in a stress relaxation test with an applied stress of 400 MPa.

Amount of Stress Relaxation after a Lapse of 5 Min in a Stress Relaxation Test with an Applied Stress of 400 MPa: 20 MPa or Lower Movable dislocations, which move when being subjected to a tensile stress of 400 MPa or lower, do not contribute to increasing tensile strength TS, and such movable dislocations draw hydrogen, thereby contributing to hydrogen transport. In the case where there is an increase in the number of such movable dislocations, there is a decrease in delayed fracture resistance. In the case where the amount of stress relaxation after a lapse of 5 min in a stress relaxation test with an applied stress of 400 MPa is more than 20 MPa, since there is an increase in the number of movable dislocations contributing to hydrogen transport in the microstructure, there is a marked decrease in delayed fracture resistance, which results in the desired delayed fracture resistance not being achieved. Therefore, in accordance with aspects of the present invention, the amount of stress relaxation after a lapse of 5 min in a stress relaxation test with an applied stress of 400 MPa is set to be 20 MPa or lower. Here, it is preferable that the amount of stress relaxation be 18 MPa or lower or more preferably 16 MPa or lower.

Hereafter, the preferable method for manufacturing the high-strength hot-rolled steel sheet according to aspects of the present invention will be described.

A steel material (slab) having the chemical composition described above is charged into a heating furnace and heated. Although there is no particular limitation on the heating temperature, it is preferable that the heating temperature be 1100° C. or higher from the viewpoint of removing segregation, dissolving precipitates, and the like and that the heating temperature be 1300° C. or lower from the viewpoint of energy efficiency and the like.

Subsequently, the heated steel material is subjected to hot rolling including rough rolling and finish rolling. In accordance with aspects of the present invention, there is no particular limitation on the conditions applied for rough rolling. After rough rolling has been performed, finish rolling is performed with a rolling finish temperature (finishing delivery temperature) of 890° C. or lower. Here, it is preferable that at least four rolling passes be performed as finish rolling from the viewpoint of reducing coarse grains, which cause a decrease in workability, and the like.

Cooling following finish rolling is performed at an average cooling rate of 10° C./s or higher to a temperature of 500° C. and at an average cooling rate of 100° C./s or higher in a temperature range from the Ms temperature to a temperature of (Ms temperature-200° C.), and coiling is thereafter performed at a coiling temperature of 250° C. or lower.

In accordance with aspects of the present invention, although the cooling conditions to a temperature of 500° C. and in a temperature range from the Ms temperature to a temperature of (Ms temperature-200° C.) are specified as described above, it is not necessary to put a particular limitation on the cooling conditions in a temperature range from a temperature of 500° C. to the Ms temperature. As illustrated in the FIGURE, cooling to a temperature of 500° C. may be continued to the Ms temperature, or cooling to a temperature of 500° C. may be stopped first to perform cooling to the Ms temperature at another cooling rate, because this causes no problem.

Subsequently, in accordance with aspects of the present invention, coiling is first performed, the coiled steel sheet is uncoiled, and the uncoiled steel sheet is subjected to at least one rolling pass with a rolling load per unit width of 0.20 ton/mm or more. Alternatively, after the cooling following the above-described finish rolling has been performed to a temperature of 250° C. or lower, the cooled steel sheet, which has not been subjected to coiling, may be subjected to at least one rolling pass with a rolling load per unit width of 0.20 ton/mm or more online and then coiled.

The temperature described above denotes the temperature (surface temperature) at the central position in the width direction of the steel sheet, and the average cooling rate described above denotes the cooling rate at the central position (surface) in the width direction of the steel sheet.

Hereafter, the reasons for the limitations on the conditions applied for finish rolling and cooling will be described.

Finishing Delivery Temperature: 890° C. Or Lower

In accordance with aspects of the present invention, to promote the formation of austenite grains having a large aspect ratio, the rolling finish temperature of finish rolling (finishing delivery temperature) is set to be 890° C. or lower. In the case where the finishing delivery temperature is higher than 890° C., since recrystallization of austenite grains markedly occurs and since it is not possible to form prior austenite grains having a large aspect ratio, it is not possible to form the desired steel sheet microstructure. Therefore, the finishing delivery temperature is set to be 890° C. or lower. Here, it is preferable that the finishing delivery temperature be 870° C. or lower, more preferably 850° C. or lower, or even more preferably 830° C. or lower. Although there is no particular limitation on the lower limit of the steel sheet temperature at which cooling following finish rolling starts, it is preferable that the cooling start temperature be 700° C. or higher from the viewpoint of the shape stability of a steel sheet.

Cooling to a Temperature of 500° C.: An Average Cooling Rate of 10° C./s or Higher After finish rolling has been performed, in the case where the average cooling rate in cooling to a temperature of 500° C. is lower than 10° C./s, since a ferrite phase, a bainite phase, and the like are formed in large amounts, it is not possible to form the desired steel sheet microstructure. Therefore, the average cooling rate in cooling to a temperature of 500° C. is set to be 10° C./s or higher. Here, it is preferable that the average cooling rate be 20° C./s or higher or more preferably 30° C./s or higher. In addition, although there is no particular limitation on the upper limit of the average cooling rate, it is preferable that the average cooling rate be 1000° C./s or lower from the viewpoint of the shape stability and the like of a steel sheet.

Cooling in a Temperature Range from the Ms Temperature to a Temperature of (Ms Temperature-200° C.): An Average Cooling Rate of 100° C./s or Higher In the case where the average cooling rate in cooling in a temperature range from the Ms temperature to a temperature of (Ms temperature-200° C.) is lower than 100° C./s, since a bainite phase is formed, it is not possible to form the desired steel sheet microstructure. Therefore, the average cooling rate in cooling in a temperature range from the Ms temperature to a temperature of (Ms temperature-200° C.) is set to be 100° C./s or higher. Here, it is preferable that the average cooling rate be 200° C./s or higher or more preferably 300° C./s or higher. Although there is no particular limitation on the upper limit of the average cooling rate, it is preferable that the average cooling rate be 1000° C./s or lower from the viewpoint of the shape stability and the like of a steel sheet. However, in the case where a temperature of (Ms temperature-200° C.) is equal to or lower than the coiling temperature, the average cooling rate is defined as an average cooling rate in a temperature range from the Ms temperature to the coiling temperature. Here, the Ms temperature is a temperature at which martensite transformation starts. The transformation temperature (Ms temperature) is derived from a thermal expansion-contraction curve which is obtained by performing a predetermined heating-cooling cycle test with a thermo-dilatometer (Formaster testing machine: trade name).

Coiling Temperature: 250° C. Or Lower

In the case where the coiling temperature is higher than 250° C., since a bainite phase and the like are formed, it is not possible to form the desired steel sheet microstructure including a martensite phase in an amount of 95% or more in terms of area fraction. Therefore, the coiling temperature is set to be 250° C. or lower. Here, it is preferable that the coiling temperature be 200° C. or lower or more preferably 180° C. or lower.

Rolling Load Per Unit Width: 0.20 ton/mm or More

In accordance with aspects of the present invention, at least one rolling pass (cold rolling or warm rolling) is performed after coiling has been performed, or alternatively, online before coiling is performed. The purpose of such rolling is to form a dislocation structure in which dislocations tangle with each other, thereby reducing the number of movable dislocations as much as possible so that a decrease in delayed fracture resistance is inhibited. In the case where the rolling load per unit width is less than 0.20 ton/mm, since the movable dislocations do not sufficiently tangle with each other, it is not possible to achieve the desired delayed fracture resistance. Therefore, the rolling load per unit width in rolling, which is performed after uncoiling following coiling has been performed, or alternatively, online before coiling is performed, is set to be 0.20 ton/mm or more. Here, it is preferable that the rolling load per unit width be 0.30 ton/mm or more or more preferably 0.40 ton/mm or more.

EXAMPLES

Molten steels having the chemical compositions given in Table 1, which had been prepared by using a vacuum melting furnace, were made into steel ingots, and the ingots were subjected to rough rolling so as to be made into slabs. The obtained slabs were heated to a temperature of 1250° C. and the heated slabs were subjected to finish hot rolling consisting of seven rolling passes with the finishing delivery temperatures given in Table 2. Subsequently, after cooling following finish rolling had been performed under the conditions given in Table 2, the cooled steel sheets were subjected to a treatment simulating coiling, in which the cooled steel sheets were charged into a furnace (the furnace temperatures were set to be equal to the respective coiling temperatures given in Table 2), held for one hour, and thereafter cooled in the furnace to room temperature, so as to be made into hot-rolled steel sheets (having a thickness of 3.0 mm). After the treatment simulating coiling had been performed, cold rolling was performed with the rolling loads per unit width given in Table 2. Here, one of the steel sheets (steel sheet No. 20) was cooled to a temperature of 250° C. or lower before the treatment simulating coiling was performed, the cooled steel sheet was subjected to rolling online with the rolling load per unit width given in Table 2, and the rolled steel sheet was subjected to a treatment simulating coiling, in which the rolled steel sheet was charged into a furnace (the furnace temperature was set to be equal to the coiling temperature given in Table 2), held for one hour, and thereafter cooled in the furnace to room temperature.

After pickling had been performed on the obtained hot-rolled steel sheets to remove oxide layers, microstructure observation, a tensile test, a stress relaxation test, and a delayed fracture test were performed. The test methods were as follows.

(1) Microstructure Observation (Area Fractions of Respective Phases)

A sample (test specimen for microstructure observation) was taken from the obtained hot-rolled steel sheet, a cross section in the thickness direction parallel to the rolling direction was polished and etched in an etching solution (3% nital), and a microstructure at a position located at ¼ of the thickness was observed by using a scanning electron microscope SEM (at a magnification of 1500 times) to take microstructure photographs in three fields of view for each sample. From the obtained secondary electron image data, the area fractions of respective phases were determined by using Image-Pro produced by Media Cybernetics, Inc., and the average area fraction in the three fields of view of each of the respective phases was defined as the area fraction of each of the respective phases. The expression "area fraction of each of respective phases" denotes the proportion of the area of each of the respective phases with respect to the total area of a field of view observed. In the image data, a polygonal ferrite phase is identified as a black region, a lower bainite phase is identified as a gray or light-gray region containing uniformly oriented carbides, a martensite phase is identified as a gray or light-gray region containing carbides having plural orientations or a white or light-gray region containing no carbide, and a retained austenite phase is identified as a white or light-gray region containing no carbide. Since there was a case where it was not possible to distinguish between a martensite phase and a retained austenite phase, the retained austenite phase was determined by using X-ray diffractometry, and the area fraction of a martensite phase was calculated by subtracting the obtained area fraction of a retained austenite phase from the total area fraction of a martensite phase and a retained austenite phase obtained from the SEM image. Here, in accordance with aspects of the present invention, the meaning of "martensite phase" may include auto-tempered martensite and tempered martensite. Carbides have a white linear or point-like shape.

The area fraction of a retained austenite phase was determined by using X-ray diffractometry. The determination method was as follows.

A test specimen for determination was taken from the obtained hot-rolled steel sheet, the surface layer of the obtained test specimen was removed by grinding up to a thickness of ¼+0.1 mm of the thickness of the test specimen, and a layer having a thickness of 0.1 mm was further removed by chemical polishing. The chemically polished surface was used as an observation surface, and an X-ray diffractometer with the Kα1-ray of Mo was used to determine the integrated reflection intensities from the (200)-plane, (220)-plane, and (311)-plane of fcc-iron (austenite) and from the (200)-plane, (211)-plane, and (220)-plane of bcc-iron (ferrite). By calculating a volume fraction from the ratio of the integrated reflection intensity from the planes of fcc-iron to the integrated reflection intensity from the planes of bcc-iron, the volume fraction was defined as the area fraction of a retained austenite phase.

The obtained area fractions of the respective phases are given in Table 3. Here, the area fractions of phases other than a martensite phase and a retained austenite phase were summed up and given in the column "Total Area Fraction of Other Phases (%)".

In addition, after the test specimen for microstructure observation described above had been etched by using an etching solution (picric acid saturated aqueous solution+surfactant+oxalic acid) to expose the grain boundaries of prior austenite (γ) at a position located at ¼ of the thickness in a cross section in the thickness direction parallel to the rolling direction, the aspect ratio (length in the rolling direction/length in the thickness direction) of a prior austenite grain was determined. The number of grains observed was 500, and the average aspect ratio of the 500 grains was defined as the average aspect ratio of prior austenite grains of the relevant steel sheet.

(2) Tensile Test

A JIS No. 5 tensile test specimen (refer to JIS Z 2201) was taken from the obtained hot-rolled steel sheet so that the tensile direction was perpendicular to the rolling direction, and a tensile test was performed in accordance with the prescription in JIS Z 2241 with a strain rate of $10^{-3}$/s to determine tensile strength TS. Here, the front and back surfaces of the test specimen were in the pickled state.

(3) Stress Relaxation Test

A JIS No. 5 tensile test specimen (refer to JIS Z 2201) was taken from the obtained hot-rolled steel sheet so that the tensile direction was perpendicular to the rolling direction, a tensile test was performed in accordance with the prescription in JIS Z 2241 with a strain rate of $10^{-3}$/s, in which strain increase was stopped when the stress reached 400 MPa and held for 5 min, to determine a decrease in stress from 400 MPa, and the obtained amount of decrease in stress was defined as the amount of stress relaxation after a lapse of 5 min. Here, the front and back surfaces of the test specimen were in the pickled state. As a tensile testing machine, Autograph AG-X produced by Shimadzu Corporation was used.

(4) Delayed Fracture Test

A tensile test specimen having a parallel portion length of 15 mm and a parallel portion width of 6 mm was taken from the obtained hot-rolled steel sheet so that the tensile direction was perpendicular to the rolling direction, an SSRT test (slow strain-rate tensile test) was performed at a cross head speed of 0.005 mm/min while hydrogen charge was performed in an electrolyte (3% NaCl+0.3% $NH_4SCN$ aqueous solution) to determine fracture stress, and the ratio (SSRT fracture stress ratio) of the fracture stress to the tensile strength TS was calculated. Here, the amount of diffusible hydrogen at the time of fracture was determined by performing thermal desorption analysis (TDA) on the fractured sample by using gas chromatography. Here, the total amount of hydrogen desorbed in a temperature range from room temperature to a temperature of 210° C. was defined as the amount of diffusible hydrogen. A case where the amount of diffusible hydrogen was 0.80 mass ppm to 1.20 mass ppm was judged as a case where a delayed fracture test was performed under satisfactory conditions. When the amount of diffusible hydrogen was out of the range described above, a delayed fracture test was performed again by changing hydrogen charge conditions so that the amount of diffusible hydrogen was within the range described above. Here, the front and back surface layers each having a thickness of 0.3 mm were removed from the test specimen by grinding before the test specimen was used in the test. A case where the determined fracture stress was 90% or more of the tensile strength TS (that is, the SSRT fracture stress ratio was 90% or more) was judged as a case of excellent delayed fracture resistance.

The obtained results are given in Table 3.

TABLE 1

| Steel No. | Chemical Composition (mass %) C | Si | Mn | P | S | Al | Group A (Mo, V, Nb, Ti) | Group B (Cr, Ni, Cu) | Group C (B) | Group D (Ca, REM) | Group E (Sb, Sn) | N | Note |
|---|---|---|---|---|---|---|---|---|---|---|---|---|---|
| A | 0.08 | 0.50 | 3.1 | 0.015 | 0.0003 | 0.022 | — | — | — | — | — | 0.003 | Example |
| B | 0.07 | 0.50 | 1.7 | 0.022 | 0.0025 | 0.035 | Mo: 0.1 | Ni: 0.5 | B: 0.0023 | — | — | 0.004 | Example |
| C | 0.19 | 1.50 | 2.0 | 0.015 | 0.0019 | 0.030 | — | — | — | — | — | 0.005 | Example |
| D | 0.20 | 1.00 | 2.5 | 0.010 | 0.0021 | 0.031 | — | — | B: 0.0035 | — | — | 0.003 | Example |
| E | 0.11 | 0.10 | 2.0 | 0.005 | 0.0007 | 0.030 | Mo: 0.1, Ti: 0.07 | — | B: 0.0018 | — | Sb: 0.01 | 0.004 | Example |
| F | 0.17 | 0.70 | 1.3 | 0.010 | 0.0015 | 0.038 | — | Cr: 0.9 | — | Ca: 0.0015 | — | 0.003 | Example |
| G | 0.15 | 0.20 | 3.0 | 0.015 | 0.0010 | 0.085 | Nb: 0.02 | Cu: 0.2 | — | REM: 0.001 | Sn: 0.01 | 0.003 | Example |
| H | 0.06 | 0.30 | 2.5 | 0.010 | 0.0015 | 0.033 | Mo: 0.2, Ti: 0.02 | — | B: 0.0020 | — | — | 0.006 | Comparative Example |
| I | 0.23 | 0.50 | 3.0 | 0.011 | 0.0015 | 0.034 | Ti: 0.01 | — | B: 0.0005 | — | — | 0.002 | Comparative Example |
| J | 0.11 | 3.10 | 2.2 | 0.010 | 0.0015 | 0.030 | Ti: 0.03 | Ni: 0.3 | — | REM: 0.002 | — | 0.003 | Comparative Example |
| K | 0.15 | 0.50 | 0.9 | 0.012 | 0.0016 | 0.042 | Mo: 0.2 | Ni: 0.4, Cu: 0.2 | — | Ca: 0.0010 | — | 0.003 | Comparative Example |
| L | 0.15 | 1.00 | 4.5 | 0.010 | 0.0016 | 0.033 | — | — | — | — | — | 0.003 | Comparative Example |
| M | 0.15 | 0.10 | 2.6 | 0.011 | 0.0015 | 1.500 | Mo: 0.2 | — | B: 0.0020 | — | — | 0.003 | Comparative Example |

TABLE 2

| Steel Sheet No. | Steel No. | Finish Rolling Finishing Delivery Temperature (° C.) | Cooling after Rolling: Average Cooling Rate to 500° C. (° C./s) | Cooling Stop Temperature (° C.) | Average Cooling Rate from Ms to (Ms-200° C.) (° C./s) | Coiling Coiling Temperature (° C.) | Rolling: Rolling Load per Unit Width (ton/mm) | Number of Rolling Passes (times) | Transformation Temperature Ms(° C.) | Note |
|---|---|---|---|---|---|---|---|---|---|---|
| 1 | A | 830 | 30 | 500 | 500 | 80 | 1.00 | 1 | 400 | Example |
| 2 | A | 900 | 30 | 500 | 500 | 80 | 1.00 | 1 | 400 | Comparative Example |
| 3 | A | 830 | 30 | 500 | 500 | 80 | — | — | 400 | Comparative Example |
| 4 | B | 850 | 50 | 450 | 300 | 25 | 0.80 | 1 | 449 | Example |
| 5 | B | 850 | 50 | 450 | 50 | 25 | 0.80 | 1 | 446 | Comparative Example |
| 6 | B | 850 | 50 | 450 | 300 | 270 | 0.80 | 1 | 441 | Comparative Example |
| 7 | C | 890 | 100 | 400 | 150 | 150 | 0.40 | 1 | 403 | Example |
| 8 | C | 890 | 100 | 400 | 150 | 150 | 0.15 | 1 | 403 | Comparative Example |
| 9 | C | 890 | 8 | 400 | 150 | 150 | 0.40 | 1 | 394 | Comparative Example |
| 10 | D | 850 | 15 | 450 | 100 | 200 | 0.25 | 2 | 379 | Example |
| 11 | E | 860 | 30 | 500 | 200 | 250 | 0.80 | 1 | 431 | Example |
| 12 | F | 880 | 15 | 500 | 200 | 150 | 0.60 | 1 | 430 | Example |
| 13 | G | 820 | 50 | 450 | 200 | 130 | 1.20 | 1 | 379 | Example |
| 14 | H | 870 | 15 | 500 | 200 | 200 | 0.50 | 1 | 431 | Comparative Example |
| 15 | I | 870 | 15 | 500 | 200 | 200 | 0.50 | 1 | 350 | Comparative Example |
| 16 | J | 870 | 15 | 500 | 200 | 200 | 0.50 | 1 | 398 | Comparative Example |
| 17 | K | 870 | 15 | 500 | 200 | 200 | 0.50 | 1 | 417 | Comparative Example |
| 18 | L | 870 | 15 | 500 | 200 | 100 | 0.50 | 1 | 320 | Comparative Example |
| 19 | M | 870 | 15 | 500 | 200 | 150 | 0.50 | 1 | 354 | Comparative Example |
| 20 | A | 830 | 30 | 500 | 500 | *80 | 1.00 | 1 | 400 | Example |

*Coiling was performed after rolling had been performed online.

TABLE 3

| Steel Sheet No. | Steel No. | Steel Sheet Microstructure: Martensite Phase Area Fraction (%) | Retained γ Phase Area Fraction (%) | Total Area Fraction of Other Phases (%) | Average Aspect Ratio of Prior γ Grains | Stress Relaxation Amount of Stress Relaxation after a Lapse of 5 min* (MPa) | Tensile Strength Tensile Strength TS (MPa) | Delayed Fracture Resistance SSRT Fracture Stress Ratio (%) | Note |
|---|---|---|---|---|---|---|---|---|---|
| 1 | A | 100 | — | — | 7.7 | 7 | 1198 | 96 | Example |
| 2 | A | 100 | — | — | 2.8 | 8 | 1203 | 86 | Comparative Example |
| 3 | A | 100 | — | — | 7.5 | 21 | 1199 | 88 | Comparative Example |
| 4 | B | 100 | — | — | 5.4 | 5 | 1188 | 99 | Example |
| 5 | B | 86 | 2 | 12 | 5.6 | 6 | 1156 | 99 | Comparative Example |
| 6 | B | 72 | 3 | 25 | 5.8 | 5 | 1142 | 100 | Comparative Example |
| 7 | C | 98 | 2 | — | 3.8 | 14 | 1565 | 93 | Example |
| 8 | C | 98 | 2 | — | 3.5 | 22 | 1560 | 85 | Comparative Example |
| 9 | C | 84 | 4 | 12 | 3.7 | 16 | 1591 | 83 | Comparative Example |
| 10 | D | 96 | 2 | 2 | 5.1 | 12 | 1534 | 95 | Example |
| 11 | E | 96 | 1 | 3 | 8.5 | 10 | 1326 | 99 | Example |
| 12 | F | 99 | 1 | — | 3.6 | 10 | 1467 | 94 | Example |
| 13 | G | 100 | — | — | 11.3 | 6 | 1428 | 100 | Example |
| 14 | H | 99 | 1 | — | 4.4 | 6 | 1160 | 100 | Comparative Example |
| 15 | I | 98 | 2 | — | 3.9 | 10 | 1772 | 55 | Comparative Example |
| 16 | J | 57 | 6 | 37 | 4.1 | 19 | 1221 | 86 | Comparative Example |
| 17 | K | 55 | 4 | 41 | 6.9 | 23 | 1206 | 77 | Comparative Example |
| 18 | L | 97 | 3 | — | 8.9 | 16 | 1489 | 82 | Comparative Example |
| 19 | M | 52 | 5 | 43 | 5.4 | 15 | 1265 | 80 | Comparative Example |
| 20 | A | 100 | — | — | 7.8 | 8 | 1200 | 96 | Example |

*When a stress of 400 MPa was applied.

The examples of the present invention were all high-strength hot-rolled steel sheets having both high strength represented by a tensile strength TS of 1180 MPa or higher and excellent delayed fracture resistance represented by an SSRT fracture stress ratio of 90% or more. On the other hand, in the case of the comparative examples, which were out of the range of the present invention, the desired high strength was not achieved, or the excellent delayed fracture resistance was not achieved.

The invention claimed is:

1. A high-strength hot-rolled steel sheet having a chemical composition containing, by mass %, C: 0.07% to 0.20%, Si: 1.50% or less, Mn: 1.0% to 4.0%, P: 0.030% or less, S: 0.0030% or less, Al: 0.010% to 1.000%, and a balance of Fe and incidental impurities, a microstructure including, in terms of area fraction, 95% or more of a martensite phase at a position located at ¼ of a thickness of the steel sheet, in which an average aspect ratio of prior austenite grains is 3.0 or more, an amount of stress relaxation after a lapse of 5 min of 20 MPa or lower in a stress relaxation test with an applied stress of 400 MPa, and a tensile strength of 1180 MPa or higher.

2. The high-strength hot-rolled steel sheet according to claim 1, wherein the chemical composition further contains one, two, or more selected from Group A to Group E below:

Group A: by mass %, one, two, or more selected from Mo: 0.005% to 2.0%, V: 0.005% to 2.0%, Nb: 0.005% to 0.20%, and Ti: 0.005% to 0.20%

Group B: by mass %, one, two, or more selected from Cr: 0.005% to 2.0%, Ni: 0.005% to 2.0%, and Cu: 0.005% to 2.0%

Group C: by mass %, B: 0.0001% to 0.0050%

Group D: by mass %, one or two selected from Ca: 0.0001% to 0.0050% and REM: 0.0001% to 0.0050%

Group E: by mass %, one or two selected from Sb: 0.0010% to 0.10% and Sn: 0.0010% to 0.50%.

3. The high-strength hot-rolled steel sheet according to claim 1, wherein the microstructure further includes, in terms of area fraction, 5% or less of a retained austenite phase.

4. A method for manufacturing the high-strength hot-rolled steel sheet of claim 1, the method comprising performing heating, rough rolling, and finish rolling on a steel material, wherein the steel material is a steel material having the chemical composition according to claim 1, wherein the finish rolling is performed with a finishing delivery temperature of 890° C. or lower, and wherein, after the finish rolling performed, cooling is performed at an average cooling rate of 10° C./s or higher to a temperature of 500° C. and at an average cooling rate of 100° C./s or higher in a temperature range from a Ms temperature to a temperature of (Ms temperature-200° C.), coiling is thereafter performed at a coiling temperature of 250° C. or lower, and the coiled steel sheet is subjected to at least one rolling pass with a rolling load per unit width of 0.20 ton/mm or more, or alternatively, after the finish rolling performed, the cooling is performed to a temperature of 250° C. or lower, and the cooled steel sheet, before being subjected to coiling, is subjected to at least one rolling pass with a rolling load per unit width of 0.20 ton/mm or more and then coiled; thereby producing the high-strength hot rolled steel sheet of claim 1.

5. The high-strength hot-rolled steel sheet according to claim 2, wherein the microstructure further includes, in terms of area fraction, 5% or less of a retained austenite phase.

6. A method for manufacturing the high-strength hot-rolled steel sheet of claim 2, the method comprising performing heating, rough rolling, and finish rolling on a steel material, wherein the steel material is a steel material having the chemical composition according to claim 2, wherein the finish rolling is performed with a finishing delivery temperature of 890° C. or lower, and wherein, after the finish rolling performed, cooling is performed at an average cooling rate of 10° C./s or higher to a temperature of 500° C. and at an average cooling rate of 100° C./s or higher in a temperature range from a Ms temperature to a temperature of (Ms temperature-200° C.), coiling is thereafter performed at a coiling temperature of 250° C. or lower, and the coiled steel sheet is subjected to at least one rolling pass with a rolling load per unit width of 0.20 ton/mm or more, or alternatively, after the finish rolling performed, the cooling is performed to a temperature of 250° C. or lower, and the cooled steel sheet, before being subjected to coiling, is subjected to at least one rolling pass with a rolling load per unit width of 0.20 ton/mm or more and then coiled; thereby producing the high-strength hot rolled steel sheet of claim 2.

* * * * *